United States Patent [19]

Lupoli et al.

[11] Patent Number: 4,721,846

[45] Date of Patent: Jan. 26, 1988

[54] CANISTER HEATER WITH PTC WAFER

[75] Inventors: Peter J. Lupoli, Hamden; Donald J. Mattis, Norwalk; Robert S. Miller, Stratford, all of Conn.

[73] Assignee: Casco Products Corporation, Bridgeport, Conn.

[21] Appl. No.: 881,811

[22] Filed: Jul. 2, 1986

[51] Int. Cl.[4] ..... F24H 3/04; F02M 33/02; F02M 31/00

[52] U.S. Cl. ..... 219/381; 55/208; 55/267; 123/549; 219/206; 219/374

[58] Field of Search ..... 219/374, 381, 206, 504, 219/505; 123/519, 557, 549; 55/208, 267

[56] References Cited

U.S. PATENT DOCUMENTS

| | | | |
|---|---|---|---|
| 3,191,587 | 6/1965 | Hall | 123/519 |
| 3,200,569 | 8/1965 | Wheeler | 55/208 |
| 3,221,724 | 12/1965 | Wentworth | 123/519 |
| 3,456,635 | 7/1969 | Hervert | 123/519 |
| 3,675,634 | 7/1972 | Tatsutomi et al. | 123/519 |
| 3,757,753 | 9/1973 | Hunt | 123/136 |
| 3,831,353 | 8/1974 | Toth | 123/519 |
| 3,854,911 | 12/1974 | Walker | 123/519 |
| 3,927,300 | 12/1975 | Wada et al. | 219/381 |
| 4,103,658 | 8/1978 | Bernecker | 123/557 |
| 4,108,125 | 8/1978 | Marcoux et al. | 123/549 |
| 4,212,275 | 7/1980 | Inoue | 219/206 |
| 4,279,234 | 7/1981 | Marcoux et al. | 123/549 |
| 4,306,894 | 12/1981 | Fukami et al. | 123/519 |
| 4,362,142 | 12/1982 | Igashira et al. | 219/206 |
| 4,387,291 | 6/1983 | Keppel | 123/557 |
| 4,387,690 | 6/1983 | Chiavaroli | 123/549 |
| 4,387,691 | 6/1983 | Marcoux et al. | 123/557 |
| 4,448,173 | 5/1984 | Abe et al. | 123/549 |
| 4,450,823 | 5/1984 | Abe et al. | 123/549 |
| 4,477,715 | 10/1984 | Bell et al. | 219/205 |

FOREIGN PATENT DOCUMENTS

| | | |
|---|---|---|
| 56-544 | 1/1981 | Japan . |
| 227405 | 6/1925 | United Kingdom . |
| 500446 | 2/1939 | United Kingdom . |
| 620397 | 3/1949 | United Kingdom . |
| 659268 | 10/1951 | United Kingdom . |
| 673702 | 6/1952 | United Kingdom . |
| 704491 | 2/1954 | United Kingdom . |
| 706045 | 3/1954 | United Kingdom . |
| 944669 | 12/1963 | United Kingdom . |
| 1530152 | 10/1978 | United Kingdom . |
| 1533559 | 11/1978 | United Kingdom . |
| 1537302 | 12/1978 | United Kingdom . |
| 2124103 | 2/1984 | United Kingdom . |

*Primary Examiner*—Philip H. Leung
*Assistant Examiner*—Geoffrey S. Evans
*Attorney, Agent, or Firm*—Mitchell D. Bittman

[57] ABSTRACT

An electric heater assemblage for attachment to the air intake opening of a fuel vapor recovery canister of the type containing material adapted to alternately adsorb and store, or release fuel vapor. The assemblage includes a wafer of electric resistance heating material, and electrical connections for effecting energization of the wafer. The wafer has opposite expansive surfaces, and there is a first wall located at one side of the wafer and having an expansive surface coextensive with one wafer surface, and a second wall located at the opposite side of the wafer and having an expansive surface coextensive with the other wafer surface. The first wall and wafer thus define a first chamber, and the second wall and wafer define a second chamber in communication with the first chamber at the periphery of the wafer. A housing that carries the wafers and walls directs air from the exterior of the canister into the first chamber, past one side of the wafer and its periphery and into the second chamber, past the opposite side of the wafer and thereafter to the interior of the canister, for imparting heat to the adsorbent material contained therein. The arrangement is characterized by both high efficiency and low cost.

15 Claims, 8 Drawing Figures

22
21
4
50
48
32
46
40
24
44
2
5
52
34
36

53
60
30
24
32
40
44
18
56
52
21

53
60
21
52
38

10
15
16
12
14
30
18
24
48
22
44
42
56
50
54
41
32
20
26
28
40
52
60
62
3
21

21
20
52
36
26
28
32

CANISTER HEATER WITH PTC WAFER

CROSS RFFERENCES TO RELATED APPLICATIONS

U.S. Application for Patent in the names of Peter J. Lupoli, Donald J. Mattis and Robert S. Miller entitled FUEL VAPOR RECOVERY SYSTEM FOR AUTOMOTIVE VEHICLES, U.S. Ser. No. 717,515 filed Mar. 28, 1985.

STATEMENT AS TO RIGHTS TO INVENTIONS MADE UNDER FEDERALLY-SPONSORED RESEARCH AND DEVELOPMENT.

Research and development of the present invention and application have not been Federally-sponsored, and no rights are given under any Federal program.

BACKGROUND OF THE INVENTION

1. Field of the Invention

This invention relates to fuel vapor recovery canisters for automotive vehicles, and more particularly to canisters of the type containing adsorptive material and which are intended to trap and store vapors from the vehicle's fuel tank and carburetor, and to purge stored vapor and condensate during initial operation of the vehicle's engine.

2. Description of the Related Art Including Information Disclosed Under 37 CFR §§1.97–1.99

Within the past several years a number of attempts have been made to limit the escape into the atmosphere of gasoline vapors from automotive fuel systems, especially those due to evaporation which occurs while the vehicles are idle. Special fuel tank caps have been employed in order to reduce or eliminate fumes that would otherwise be released into the surroundings. In addition, there have been proposed evaporative emission control systems that involve the use of charcoal-filled canisters which are connected, through vapor lines, to the fuel tanks such that gasoline vapors from the tanks are channelled into the canisters, and adsorbed or partially condensed in the charcoal. The vapor line in such a system is connected to an inlet port located at the top of the canister. A second port on the canister is also provided, known as a "purge" port, from which a line extends to the intake manifold or carburetor of the vehicle's engine. When the vehicle is started, condensed fuel and vapor that is stored in the charcoal is released and sucked into the engine, to be burned.

Both open- and closed-bottom canisters have been proposed. In the open-bottom canister, there is typically one or more relatively large air-intake passages that can admit fresh air from the engine compartment during operation of the engine. This fresh air flow picks up much of the stored fuel from the charcoal and carries it to either the carburetor or else to the intake manifold. Additional fumes which enter the canister during engine operation are purged continuously, leaving the charcoal in a relatively "dry" condition, ready to adsorb fuel after the engine is shut down. Usually there is some type of filter material, such as fiberglass wadding, at the fresh air intake area so as to eliminate any tendency for dirt or dust to be drawn into the canister.

Some canisters have been designed to draw vapors from both the fuel tank and the carburetor float bowl during engine shutdown, and to purge such fuel vapors or their condensate during vehicle operation. Other arrangements, such as that described above, involve recovery of fumes from only the vehicle's fuel tank.

Where it is desired to draw vapors from both the fuel tank and the carburetor float bowl, there are usually required control valves in order to enable the float bowl to vent into the canister when the engine is not running, while still not interfering with the normal operation thereof. In addition, fuel tank pressure valves have been incorporated in certain vehicles, these functioning to restrict venting of the tank during idle periods, and to increase the capability of venting into the canister during engine operation. Various other arrangements have also been proposed and produced.

The major problem with evaporative emission control systems of the type employing activated carbon or activated charcoal as adsorptive materials housed in a vapor canister, is that under conditions of low ambient temperature the fuel that has been adsorbed exhibits a reluctance to be released and purged from the canister. It has been determined that with adsorptive substances currently being employed, satisfactory release of the stored fuel will occur at room temperatures and above; however, when the temperatures fall much below these values, the efficiency of the system suffers significantly. The ability of the carbon to release the fuel is poor until the canister temperature rises.

Such canister units are therefore generally located in the engine compartment of the vehicle, and with the exception of extremely cold weather, eventually the desired, elevated canister temperatures are reached. However, until this occurs the fuel occupying the canister tends to remain there, as opposed to being promptly drawn into the intake manifold so as to be burned off.

U.S. Pat. Nos. 3,221,724 and 3,757,753 disclose charcoal-containing canisters that are intended to be heated directly from heat generated by the engine when the latter is operating. In the device of patent '724, a charcoal-filled container is incorporated in the vehicle's air-strainer; heat is provided to the charcoal by air that has been heated by the engine block and exhaust manifold, and which is drawn through the air-intake port of the air-strainer compartment. In patent No. '753, heat for the canister is obtained from an open jacket formed around the exhaust pipe leading from the engine. The jacket is connected with a conduit that in turn extends to the bottom of the canister in order to permit a flow of heated air to enter the same. The upper portion of the canister has an outlet that is connected to the air-strainer for the carburetor. Both devices operate in a similar manner in that they rely upon engine heat to provide the desired vapor-purging activity in the canister.

U.S. Pat. Nos. 3,191,587 and 3,675,634 both involve charcoal-containing fuel vapor recovery canisters connected to receive and store vapors from a vehicle's fuel tank.

U.S. Pat. No. 3,927,300 relates to the use of PTC ceramic material as a self-regulating heater in a number of different applications. U.S. Pat. Nos. 4,108,125; 4,279,234; 4,387,690; 4,448,173 and 4,450,823 all disclose the use of PTC material for heating fuel as it enters the carburetor of an internal combustion engine.

The major problem with almost all fuel vapor recovery canister systems heretofore proposed is that the response is too slow as regards purging of the stored/-condensed fuel. In cold weather the temperatures in the engine compartment are low until after a prolonged period of operation. In the device noted above, which incorporates the jacket that surrounds the exhaust pipe, the actual heat transferred to the canister has been found to be inadequate, and again, largely dependent on the ambient temperatures existing in the engine compartment.

The co-pending application above identified discloses a number of arrangements that have been devised for heating air that is drawn in through the open bottom of a canister, all employing self-regulating PTC ceramic heating elements. In several embodiments a number of individual slabs are employed with zinc die-castings that form a grid, in order to provide the desired heat transfer to the air stream. In other embodiments, there is shown a single PTC element in the form of an apertured slab having a generally "honeycomb" configuration. While tests performed on these earlier designs have indicated that they perform well, efforts have since been made to simplify the various structures, as well as to effect modifications which provide a heating assembly that is less expensive while performing in a manner essentially equivalent to that of the previously constructed units.

SUMMARY OF THE INVENTION

The above disadvantages and drawbacks of prior evaporative emission control systems of the charcoal-canister type are largely obviated by the present invention which has for one object the provision of a novel and improved charcoal-type pollution control system which is especially simple in construction and reliable in operation, and which provides significant reduction in the undesirable release of fuel vapors into the atmosphere from the engine's fuel system, over a wide range of ambient temperatures.

Another object of the invention is to provide an improved pollution control system as outlined above wherein heat transfer from a single slab-like PTC element is established along an air flow path that extends through co-extensive heater chambers formed on opposite faces of the slab, and wherein there occurs maximum heat transfer to such air due to prolonged contact with both the heated opposite faces of the PTC element itself and with the opposite walls of such chambers.

Yet another object of the invention is to provide an improved pollution control system in accordance with the foregoing, wherein the heating of air entering the canister takes place along a serpentine path, resulting in an efficient transfer of heat from the PTC element.

A still further object of the invention is to provide an improved pollution control system of the kind indicated wherein the bottom of the canister is essentially completely closed, so as to eliminate the possibility of water entering through its bottom, thereby maintaining the canister interior relatively moisture free.

A related object of the invention is to provide an improved pollution control system as above characterized wherein a controlled purging of stored/condensed fuel vapors from the charcoal can be effected with a single, relatively simple slab-like heating element constituted of PTC ceramic material, the element being especially inexpensive, and economical to fabricate.

Yet another object of the invention is to provide an improved pollution control system of the kind indicated wherein the recovery of fuel vapors and condensate that have accumulated during periods when the vehicle is idle, begins substantially at the time that the vehicle engine is started, such stored fuel products being quickly and effectively drawn into the engine cylinders and immediately burned.

A still further object of the invention is to provide an improved pollution control system as outlined above, wherein the parts are simple in structure, being essentially in the form of molded plastic components and simple metal stampings, and wherein the system is adaptable for use with a variety of vehicle types, with little or no modifications being required.

The above objects are accomplished by an electric heater assemblage for attachment to the air intake opening of a fuel vapor recovery canister of the type containing material adapted to alternately adsorb and store, or release fuel vapor. The heater comprises a wafer of electric resistance heating material, and electrical connections for effecting energization of the wafer. The wafer has opposite expansive surfaces. There is a first wall which is located at one side of the wafer and has an expansive surface coextensive with one wafer surface, and a second wall located at the opposite side of the wafer and having an expansive surface coextensive with the other wafer surface. The first wall and wafer define a first chamber and the second wall and wafer define a second chamber in communication with the first chamber at the periphery of the wafer. Means are provided for directing air from the exterior of the canister into the first chamber, past one side of the wafer and the periphery of the wafer into the second chamber, and past the opposite side of the wafer and thereafter to the interior of the canister, for imparting heat to the said material contained in the canister.

The wafer is preferably constituted as a single relatively simple slab or disk of positive temperature coefficient ceramic material that exhibits a self-regulating effect by presenting increased resistance to current flow when there occurs a rise in temperature. The arrangement is such that the initial power applied to the PTC material is relatively high, to produce rapid heating, and gradually is automatically reduced as the temperatures rise. Maximum heat transfer to the air stream is achieved by virtue of a serpentine flow path that is established past both of the opposite faces of the PTC material, prior to the air entering the interior of the canister. High efficiency is thus achieved without resorting to relatively more expensive or intricate shapes of PTC material, such as multiple slabs and mountings therefor, honeycomb structures, etc.

Other features and advantages will hereinafter appear.

DESCRIPTION OF THE PREFERRED EMBODIMENT

Figure 2:
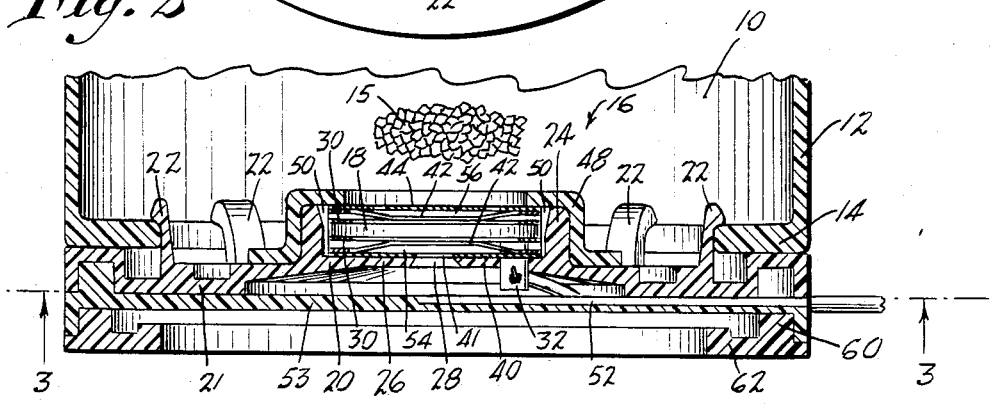
FIG. 2 is a vertical section taken on the line 2—2 of FIG. 1.
Figure 3:
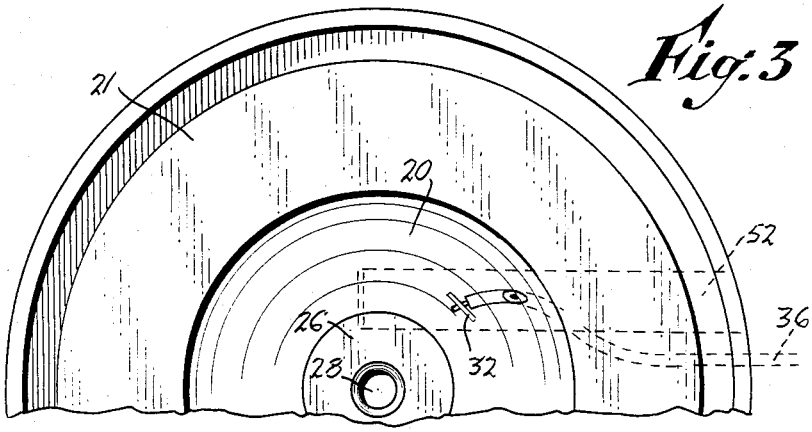
FIG. 3 is a fragmentary view taken on the line 3—3 of FIG. 2.

FIG. 2 illustrates in fragmentary vertical section a generally cylindrical fuel vapor storage canister 10 for use in an automotive pollution control system, the canister having a side wall 12 and an inner bottom flange 14. The canister is filled with a quantity of activated charcoal or carbon 15 which adsorbs vapors that are collected through a vent line (not shown) extending to the vehicle's fuel tank, and which releases the vapors to the vehicle's carburetor (not shown) after the engine is started. This operation is set forth in the specification of the co-pending application above identified.

In accordance with the present invention there is provided, as a retro-fit for an existing fuel vapor recovery canister, a novel and improved heater construction 16 for raising the temperature of the charcoal 15 in the canister 10 so as to facilitate purging of the stored fuel vapor/condensate, and to enable the purged condensate to be burned in the vehicle's engine. The heater construction 16 comprises a solid, imperforate wafer 18 preferably constituted of positive temperature coefficient (PTC) ceramic material that is mounted in a molded plastic heater housing 20 constituting an enclosure means. The housing 20 has a series of upstanding resilient integrally formed lugs or spring fingers 22, shown in FIG. 1 as being eight in number, by which the housing 20 can be snapped into the circular opening formed by the bottom flange 14 of the canister 10. The heater housing 20 comprises a base portion 21 provided with an upstanding annular flange 24 and a bottom wall 26 which together enclose portions of the wafer 18 and provide support thereto. The housing bottom wall 26 has an air inlet opening 28 as shown.

Figure 1:
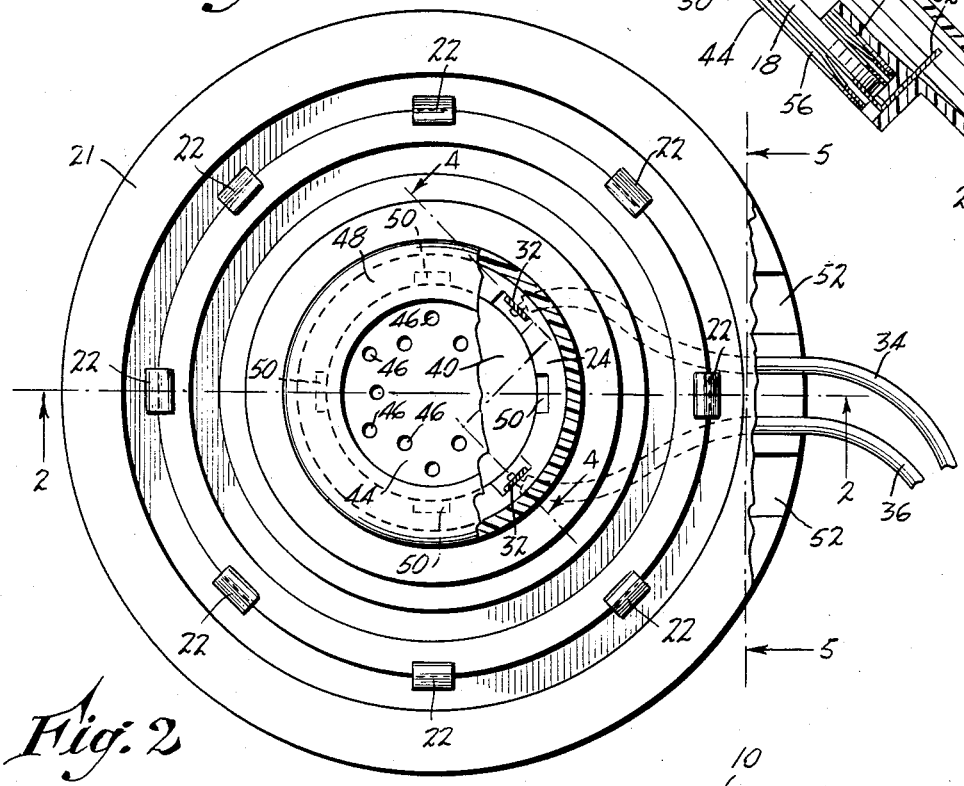
FIG. 1 is a view, partly in top plan and partly in section, of the improved heater assembly of the invention, particularly illustrating a disk-like insulating support structure and eight retainer lugs carried thereon, by which the support structure can be releasably snapped into an annular recess at the bottom of a charcoal-containing fuel-vapor recovery canister.
Figure 4:
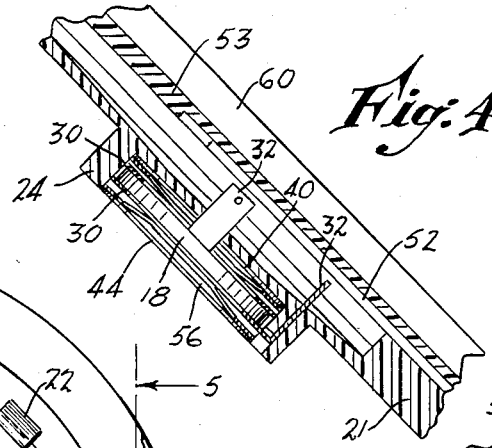
FIG. 4 is a fragmentary section taken on the line 4—4 of FIG. 1.
Figure 5:
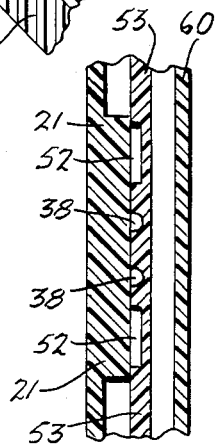
FIG. 5 is a fragmentary section taken on the line 5—5 of FIG. 1.

Disposed against the opposite faces of the wafer are ring terminals 30, having integral spade lugs or blades 32 that are connected to electrical leads 34, 36, respectively, shown in FIG. 1. FIG. 4 also shows these terminals. Grooves 38 that provide clearance for the leads 34, 36, as shown in FIGS. 1 and 5, are provided in a bottom plate described below. The leads extend to suitable control circuitry (not shown) for effecting electrical energization of the wafer 18.

Disposed against the bottom wall 26 of the heater housing 20 is an air intake regulating disk or wall 40, preferably constituted of aluminum, copper, or copper-clad circuit board (printed circuit board) having the conductive or metal-clad side facing the wafer 18. The wall 40 has an opening or aperture 41. A pair of wave washers 42 is provided, one being disposed between the air intake disk 40 and one ring terminal 30, and the other being disposed between the other ring terminal 30 and an air exhaust disk or baffle plate 44, the latter having a series of discharge apertures 46, as shown in FIG. 1.

Fitted over the upstanding flange 24 is a molded plastic retainer cap 48. The arrangement is such that the wafer 18, ring terminals 30, wave washers 42, air intake disk 40 and baffle plate 44 are held in the relative positions shown in FIG. 2, with the wave washers 42 providing a spring bias to the wafer 18 through the ring terminals and causing them to press against the opposite faces of the wafer 18 so as to establish good electrical and thermal contact therewith.

Figure 6:
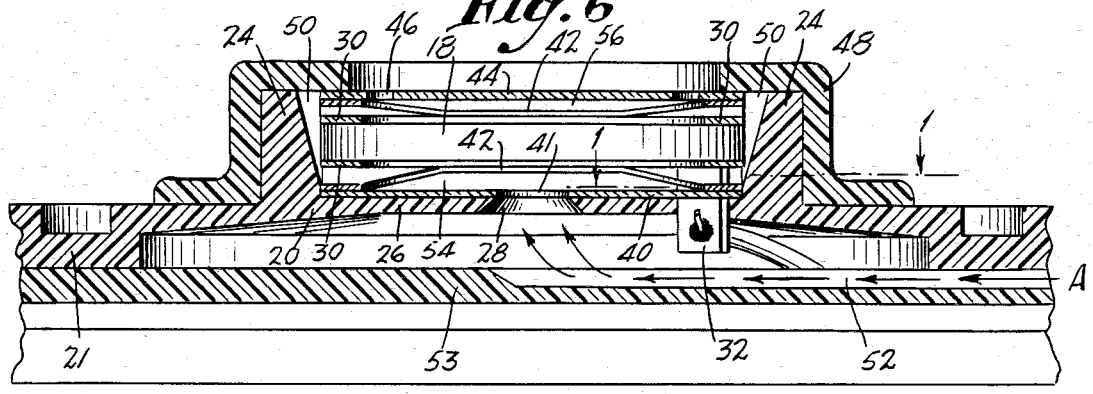
FIG. 6 is a view like that of FIG. 2, except that it is fragmentary and enlarged.

Referring again to FIGS. 1, 2 and 6, there are provided in the inner surface of the upstanding flange 24 four connecting passages or channels 50 which provide communication between the area beneath the wafer 18 and that above the wafer. The passages 50 are shown slightly enlarged or exaggerated in FIG. 2, for purposes of clarity. Also, the heater housing 20 has a portion that closes wide grooves 52 in a separate disk-like bottom plate 53, defining air intake channels which communicate with the air inlet opening 28 in the bottom wall 26 of the heater housing 20. The air flow is as indicated by the arrows labelled with the capital letter A in FIG. 6. That is, during purging of the canister, air is drawn from the engine compartment in through the intake channels 52, through the opening 28 in the bottom wall 26 and the opening 41 in the air intake disk 40 and into the chamber formed by the disk 40 and the wafer 18. In FIG. 6, this lower chamber is designated 54. Air impinging on the central portion of the underside of the wafer 18 is directed radially outwardly, absorbing heat from both the wafer 18, the lower wave washer 42 which is in thermal contact with the wafer, and the air intake disk 40 which is receiving heat from the wafer 18 by both conduction and radiation. When the air reaches the periphery of the chamber 54, it is drawn upwardly through the four connecting passages 50 and arrives at the upper chamber formed by the upper surface of the wafer 18 and the baffle plate 44. In FIG. 6, this upper chamber is designated 56. Thereafter the air is directed radially inwardly to an extent, again absorbing heat from both the wafer 18, the upper wave washer 42 and the baffle plate 44, and thereafter exits through the apertures 46 in the latter and into the interior of the canister 10. Due to the spacing of the apertures 46, the air entering the interior of the canister is characterized by a divergent flow pattern which has been found to be especially effective in achieving a more even heat distribution throughout the canister. Experimentally it has been determined that the arrangement of two series each of six holes 46, each series being on a different diameter, and where the series disposed in the larger circle is interposed circumferentially between the holes lying on the smaller circle, provides highly satisfactory results. Such results have been found to be considerably better than if a single relatively larger central passage were to be provided in the baffle plate 44.

As can be readily seen in FIGS. 2 and 5, three walls of each of the channels 52 is formed by the bottom plate 53, and the other remaining wall of each channel is formed by the heater housing 20 at its base portion 21. The bottom plate 53 is preferably sonically welded to the base portion 21 of the heater housing 20 after the parts are assembled. Also, the retainer cap 48 is preferably sonically welded to the heater housing 20.

Where the heater construction is to be employed to fit an existing canister, by the invention there is provided an additional member at the bottom of the heater construction, in the form of a mounting ring 60 having an inwardly facing flange 62. The configuration and dimensions of this flange 62 are similar to those of the canister flange 14, and accordingly where this ring 60 is incorporated into the heater, the same mounting bracket (not shown) on the vehicle can be employed. The bracket is adapted to cooperate with the flange 62, whereas previously, where no heater was associated with the canister 10, the bracket was intended to engage the flange 14. The mounting ring 60 is preferably sonically welded to the bottom plate 53 at its periphery. Typically canisters of the type shown in FIG. 2 incorporate a bottom grid (not shown) above the location of the flange 14, in order to hold captive the charcoal. This grid has been omitted from FIG. 2 in the interest of clarity, since per se, it forms no part of the present invention.

Figure 7:
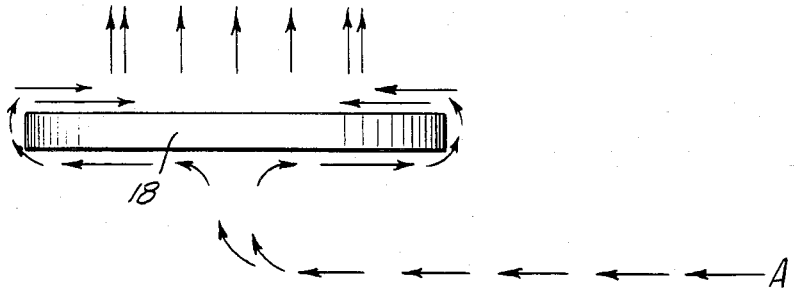
FIG. 7 is an edge view of the slab-like heating element or wafer employed in the assembly of FIGS. 1–6, the arrows illustrating the path along which air flows while it is being heated, and prior to its being drawn into the interior of the canister, during purging thereof.
Figure 8:
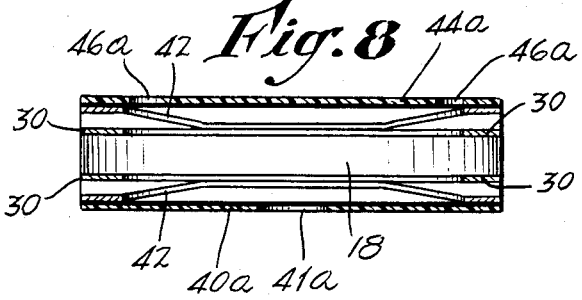
FIG. 8 is a fragmentary view of a modified heater construction wherein both the air intake disk and the baffle plate are constituted of metal-clad circuit boards, this construction constituting another embodiment of the invention.

Another embodiment of the invention is shown in FIG. 8 wherein like reference numerals have been assigned to components similar to those of the embodiment of FIGS. 1–7. There is illustrated an assemblage comprising the wafer 18, ring terminals 30, and wave washers 42. By the invention, the air intake disk or wall can be constituted as a metal-clad circuit board 40*a* having its foil side or metal-clad side facing the wafer 18. Similarly, the baffle plate can be in the form of a metal-clad board 44*a* having a series of openings 46*a* similar to those of the baffle plate 44. Again, the metal or foil side of the board faces the wafer 18. It has been found that with the relatively thin metal layer provided on such boards, usually having a thickness on the order of five or six thousandths of an inch, a rapid heating of the metal occurs upon initial energization of the wafer. That is, due to the relatively small thermal masses represented by the foils on the boards, they absorb radiation and reach a relatively high temperature quickly. As they heat, they in turn re-radiate and re-conduct heat to the air passing through the chambers formed thereby. The insulating effect of the fiberglass or phenolic material of which the board is normally constituted significantly reduces radiation or conduction by the foil in an outward direction; thus most of the heat received by the foil is eventually transferred to the air stream flowing past it.

The engagement of the foil by the wave washers enhances the conduction of heat to the foil portions, as in the previous embodiment.

The disclosed heater constructions have the following important advantages as compared to previously devised arrangements. Most notable is that the various constructions shown eliminate the need for multiple PTC elements, or alternately a PTC element having a special configuration, such as a honeycomb. The units that have been disclosed employ a single thickness slab, which is preferably circular, but which could have other geometric outlines, if desired. Only one PTC element is required, as opposed to multiple units that were spaced from one another and which required multiple electrical connections.

By virtue of the circuitous or serpentine route taken by the air stream, as shown by the arrows labelled with the capital letter A in FIGS. 6 and 7, there is achieved a maximum transfer of heat from the wafer. The wafer is in thermal contact with both wave washers 42, and with the air intake disk 40, and the baffle plate 44. Thus there are formed the two circular chambers 54 and 56, one below the wafer and a second above the wafer. Air flow into the lower chamber 54 is in a radially outward direction, whereas in the upper chamber 56 it is generally in a radially inward direction and out through the apertures 46 in the baffle plate 44. Due to the fact that the intake disk 40 and baffle plate 44 are receiving heat from the wafer 18 continuously, by both conduction and radiation, heat is transferred to the air from these components as well as from the wafer. As presently understood, such an arrangement almost doubles the heat-conductive and heat-radiating surface area exposed to the air stream, and as a result, unexpectedly high efficiency is realized. In actual tests performed on operating models, it has been confirmed that there exists a pronounced increase in the temperature of the canister interior when thermally conductive components are employed for the air intake disk 40 and baffle plate 44, as opposed to the use of thermally insulating materials for these parts.

The provision of the wave washers 42 constitutes an important feature of the present construction. First, they provide the desired spacing between the wafer 18 and the air intake disk 40 on the one hand, and the wafer 18 and baffle plate 44 on the other hand, forming the two separate chambers 54, 56 which permit air to flow in the manner explained above. Second, they provide the desired contact pressure between the ring terminals 30 and the opposite faces of the wafer 18. This type of mounting minimizes possible damage to the wafer from vibration or shock. Also, the resilience of the wave washers minimizes the chance of breakage or fracture of the wafer during assembly.

In addition, any portion of the air stream passing close to the wave washers is heated thereby, since the washers themselves are relatively hot. Finally, the wave washers provide a conductive path for heat flow between the wafer and both the air intake disk 40 and the baffle plate 44.

The provision of the resilient fingers 22 permits removal of the heater construction from the canister if the need arises, thus facilitating replacement or repair of the various components. Also, the disclosed heater construction can be applied to existing canister designs virtually without alteration to or modification of the existing structure of the canisters.

The closed-bottom type of construction minimizes the possibility of water entering the canister from road splashes. Inadvertent build-up of moisture therein, which would be detrimental to proper operation, is thus avoided.

The disclosed constructions are thus seen to represent distinct advances and improvements in the field of fuel vapor adsorption canisters.

Variations and modifications are possible without departing from the spirit of the invention.

Each and every one of the appended claims defines an aspect of the invention which is separate and distinct from all others, and accordingly it is intended that each claim be treated as such when considered in the light of the prior art devices in any determination of novelty or validity.

We claim:

1. An electric heater assemblage for attachment to the air intake opening of a fuel vapor recovery canister of the type containing material adapted to alternately adsorb and store, or release fuel vapor, comprising in combination:

(a) a wafer of electric resistance heating material, and means for making electrical connection thereto for effecting energization of the same, (b) said wafer having opposite expansive surfaces, (c) a first wall located at one side of said wafer and having an expansive surface coextensive with one wafer surface, (d) a second wall located at the opposite side of said wafer and having an expansive surface coextensive with the other wafer surface, (e) said first wall and wafer defining a first chamber and said second wall and wafer defining a second chamber in communication with the first chamber at the periphery of the wafer, and (f) means for directing air from the exterior of the canister into the first chamber, past one side of said wafer and the periphery of the wafer into the second chamber, past the opposite side of said wafer and thereafter to the interior of the canister, for imparting heat to the said material contained in the canister.

2. The invention as defined in claim 1, and further including:

(a) a canister fcr holding a quantity of said vapor adsorbing and releasing material, (b) said air-directing means comprising a molded plastic heater housing having an air inlet port and having mounting means for supporting the said walls and wafer in a fixed position with respect to the canister.

3. The invention as defined in claim 2, wherein:

(a) said heater housing carries means for releasably securing the heater housing to the canister.

4. The invention as defined in claim 2, wherein:

(a) said electrical connection means comprises a pair of ring contacts disposed on opposite faces respectively of said wafer, and (b) a pair of electrical leads respectively connected with said ring contacts and extending from the heater housing.

5. The invention as set forth in claim 1, wherein:

(a) said first wall comprises an apertured metal plate.

6. The invention as set forth in claim 1, wherein:

(a) said second wall comprises an apertured metal plate.

7. The invention as set forth in claim 1, wherein:

(a) said first wall comprises a metal-clad insulating circuit board.

8. The invention as set forth in claim 7, wherein:

(a) the metal portion of said circuit board faces the wafer.

9. The invention as set forth in claim 1, wherein:

(a) said second wall comprises a metal-clad insulating circuit board.

10. The invention as set forth in claim 9 wherein:

(a) the metal portion of said circuit board faces the wafer.

11. The invention as defined in claim 1, and further including:

(a) a cansiter for holding a quantity of said vapor adsorbing and releasing material, and (b) an enclosure having inlet and outlet passages, said enclosure surrounding the wafer and walls and being carried by said canister.

12. The invention as defined in claim 1, and further including:

(a) spacer means disposed between said walls and the wafer so as to retain the walls and wafer in spaced relation with respect to one another.

13. The invention as defined in claim 12, wherein:

(a) said spacer means comprises a pair of wave washers.

14. The invention as defined in claim 1, wherein:

(a) said wafer comprises a disk of PTC ceramic material.

15. The invention as defined in claim 14, wherein:

(a) said disk is imperforate.

* * * * *